United States Patent [19]

Pilvet

[11] 3,992,907

[45] Nov. 23, 1976

[54] AXIAL PIN TUMBLER LOCK WITH ENGAGEABLE CLUTCH MEMBER

[76] Inventor: Aksel Pilvet, R.R. No. 2, Warsaw, Ontario, Canada

[22] Filed: Mar. 27, 1975

[21] Appl. No.: 562,406

[52] U.S. Cl. ..... 70/222; 70/363; 70/379 R

[51] Int. Cl.[2] ..... E05B 13/10; E05B 17/04; E05B 27/02; G05G 5/00

[58] Field of Search ..... 70/54, 56, 222, 223, 70/363, 372, 379 R, 380, 455, 395

[56] References Cited

UNITED STATES PATENTS

| | | | |
|---|---|---|---|
| 55,048 | 5/1866 | Bohannan et al. | 70/363 |
| 1,494,765 | 5/1924 | Barrett | 70/363 |
| 1,899,996 | 3/1933 | Sullivan | 70/222 X |
| 1,976,263 | 10/1934 | Miller | 70/222 |
| 2,493,630 | 1/1950 | Julliard | 70/363 X |
| 3,303,678 | 2/1967 | Bernard et al. | 70/455 X |
| 3,485,069 | 12/1969 | Pilvet | 70/363 X |
| 3,599,455 | 8/1971 | Pilvet | 70/363 |

FOREIGN PATENTS OR APPLICATIONS

| | | | |
|---|---|---|---|
| 1,169,328 | 4/1964 | Germany | 70/455 |
| 315,006 | 2/1934 | Italy | 70/363 |
| 637,073 | 5/1950 | United Kingdom | 70/222 |

*Primary Examiner*—Paul R. Gilliam
*Assistant Examiner*—Carl F. Pietruszka

[57] ABSTRACT

A lock having a freely rotatable barrel, in which there is provided a housing for the lock, a barrel rotatable within the housing, a locking arm and hub rotatable within the housing independently of the barrel, a clutch member on the barrel swingable between engaged and disengaged positions, for engaging the hub member and rotating the locking arm, a clutch control member swingably movable within the barrel, being swingable about the axis of rotation of the barrel, and connecting with the clutch member to move it between its engaged and disengaged positions, and to restrain movement thereof when disengaged, and there being a plurality of generally cylindrical pin members located in the barrel, and lying on axes parallel with but spaced from the central axis of rotation of the barrel, and being movable relative to the barrel and to the clutch control member whereby to secure or release the clutch control member for movement relative to the barrel.

15 Claims, 10 Drawing Figures

AXIAL PIN TUMBER LOCK WITH ENGAGEABLE CLUTCH MEMBER

The present invention relates to locks of the type having a barrel or body which is rotatable by a key, and in which a locking arm or hasp or operating member, is moved by rotation of the barrel.

BACKGROUND OF THE INVENTION

Barrel type locks usually have a rotatable barrel, to which the locking arm or hasp is fastened, and which rotates with the barrel, between locking and unlocking positions. A series of locking pins or tumblers hold the barrel securely against rotation when in the locked position. Insertion of a key displaces the tumblers or pins into a predetermined position, freeing the barrel for rotation. This type of lock is relatively easy to pick, and offers little real security against theft. Since the barrel is held against rotation by the tumblers, a skilled person can feel the position of each tumbler and can open the lock relatively easily, without a key.

Locks of this type may be used to secure a dwelling for example or any other premises, and also find major application in the locking of cabinets, vending machines, display windows, photocopying machines and the like.

Various attempts have been made to render such locks thief-proof. For example, it has been proposed to separate the locking arm from the barrel and make them independently moveable relative to one another, and leaving the barrel free to rotate, when the locking arm is locked. Some form of clutch is provided between the barrel and the locking arm or hasp, and insertion of the key displaces the locking pins or tumblers, and procures engagement of the clutch so that rotation of the barrel will then rotate the locking arm.

This principal of operation makes such a lock much more difficult to pick, since there is no way in which the thief can sense the movement of the tumblers while he is attempting to pick the lock. Examples of such freely rotatable barrel locks may be found in U.S. Pat. Nos. 474,519, 2,690,070, 3,330,141, and 2,483,365 and in French Pat. No. 1,333,207.

However, these earlier proposals have suffered from various disadvantages. Locks of this type are frequently required for use within a restricted space, and often cannot be more than an inch or an inch and a half in length. The design of such earlier types of locks has been such that they could not be manufactured within such a restricted dimension, and still produce an effective and reliable lock.

Other disadvantages have involved the difficulty of providing a sufficient number of combinations of tumbler positions, and the relatively unsatisfactory shape or design of the key, and the general engineering and design requirements of such locks in some cases made them difficult to machine in mass production.

BRIEF SUMMARY OF THE INVENTION

It is therefore an objective of the invention to provide a lock overcoming the disadvantages of prior art locks having a freely rotatable barrel, in which there is provided a housing for the lock, a barrel rotatable within the housing, a locking arm and hub rotatable within the housing independently of the barrel, a clutch member on the barrel swingable between engaged and disengaged positions, for engaging the hub member and rotating the locking arm, a clutch control member swingably movable within the barrel, being swingable about the axis of rotation of the barrel, and connecting with the clutch member to move it between its engaged and disengaged positions, and to retain movement thereof when disengaged, and there being a plurality of generally cylindrical pin members located in the barrel, and lying on axes parallel with but spaced from the central axis of rotation of the barrel, and having notches formed therein, and being movable relative to the barrel and to the clutch control member whereby to secure or release the clutch control member for movement relative to the barrel, and a plurality of key ways being provided for engagement of the plunger members by any suitable key.

More particularly, it is an objective of the invention to provide a lock having the foregoing advantages in which the clutch control member incorporates an offset weight, whereby it responds to the influence of gravity when the barrel is rotated, and further incorporates means engaging said plunger members, for securing said clutch member against such movement when the key is not inserted.

More particularly, it is an objective of the invention to provide a lock having the foregoing advantages in which the clutch control member is axially adjustable forwardly and backwardly within the barrel, and incorporating adjustment washer means for securing the axial position of the clutch member in a variety of different positions relative to the plungers, thereby providing for a greater combination of locking positions.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF A SPECIFIC EMBODIMENT

Figure 1:
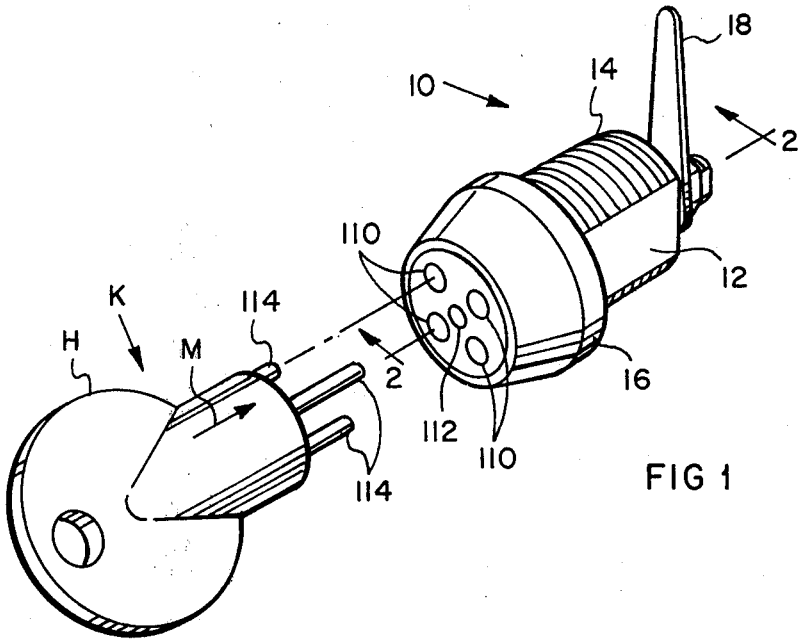
FIG. 1 is a perspective illustration showing the exterior of the lock, and a key according to the invention.

As shown in FIG. 1, the lock shown generally as 10 has a body portion 12 provided with exterior threads 14, and a boss portion 16, similar in general design to conventional locks, whereby the same may be fastened in position by any suitable nut means (not shown) with the boss 16 on the exterior of a cabinet or door for example.

A key shown as K is shown aligned with the lock 10 for operation thereof in manner to be described below.

A locking arm or hasp 18 extends from the rear of the body 12, being mounted thereon in a manner described below.

As will be understood, the locking arm 18 may itself engage a fixed portion of a cabinet or enclosure, and thereby lock a drawer or door. Alternatively, the locking arm 18 may simply engage a locking bolt, and may be of any other suitable shape such as is found in many different forms of locks, for moving a bolt or a sliding member to or fro. For the purposes of the present invention however the arm 18 is shown, it being understood that the shaping of the arm 18 is not critical and could vary widely, or could be replaced by any other form of device suitable for locking or moving a locking pin or bolt.

Figure 2:
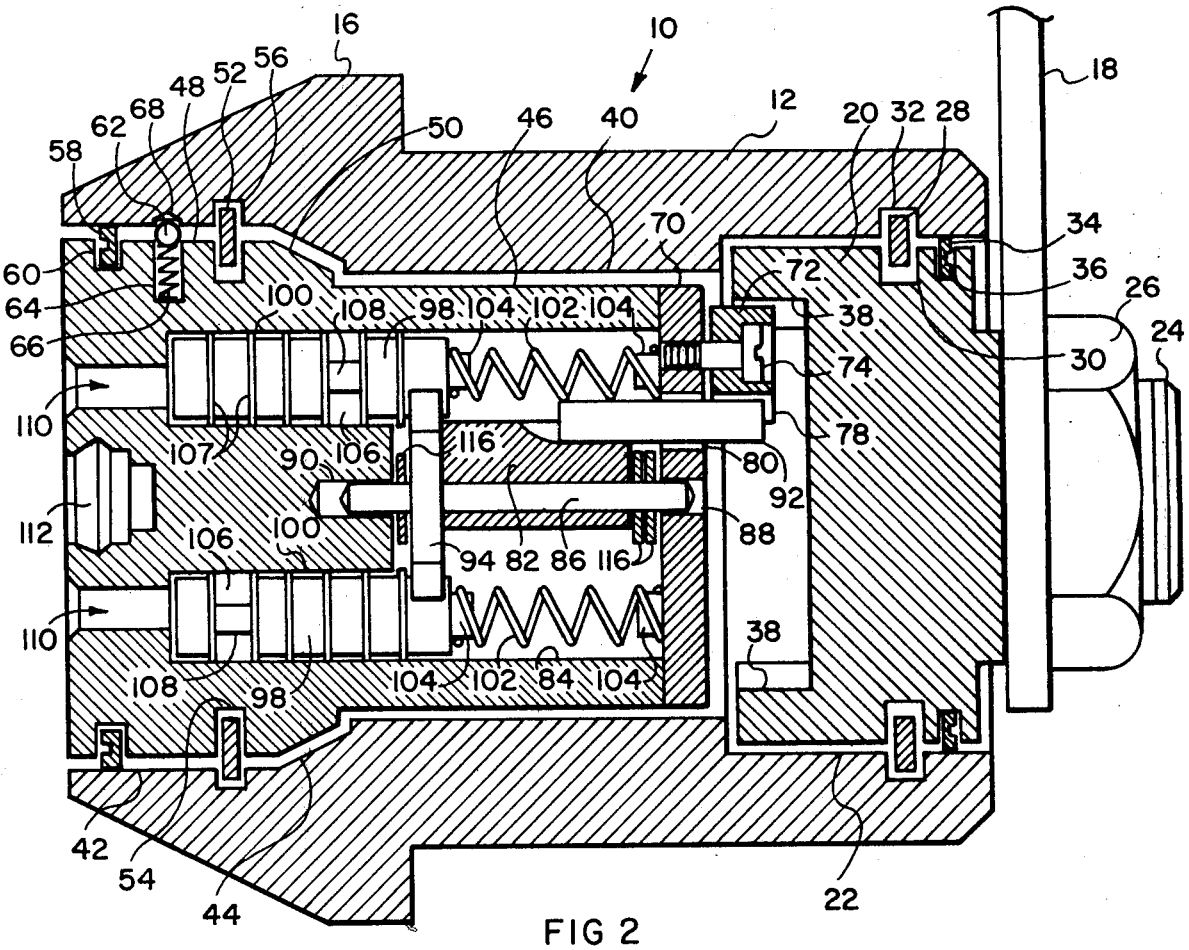
FIG. 2 is a sectional side elevation of the lock of FIG. 1 along the line 2—2.
Figure 3:
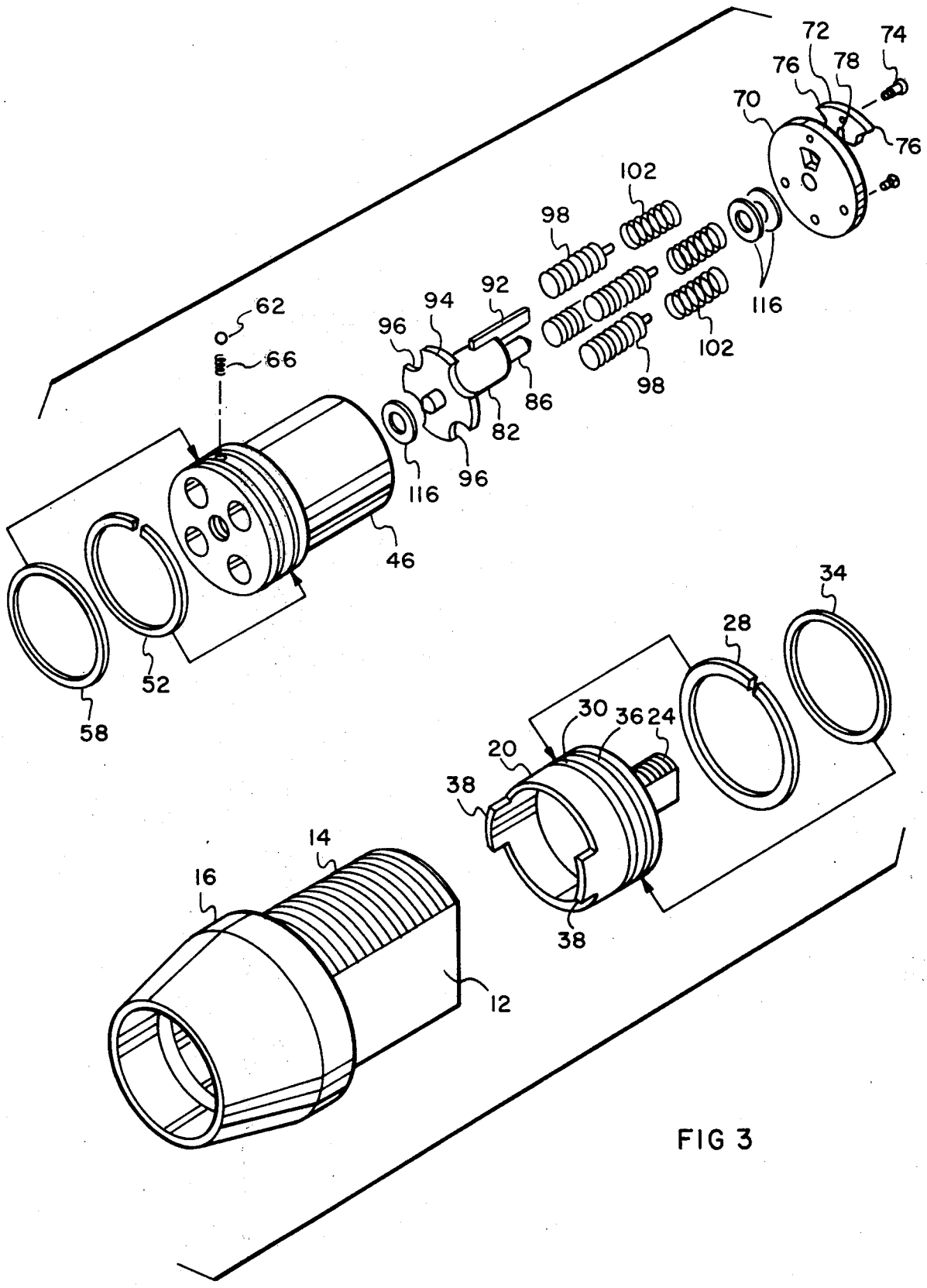
FIG. 3 is an exploded perspective illustration showing the various parts of the lock of FIGS. 1 and 2.
Figure 4:
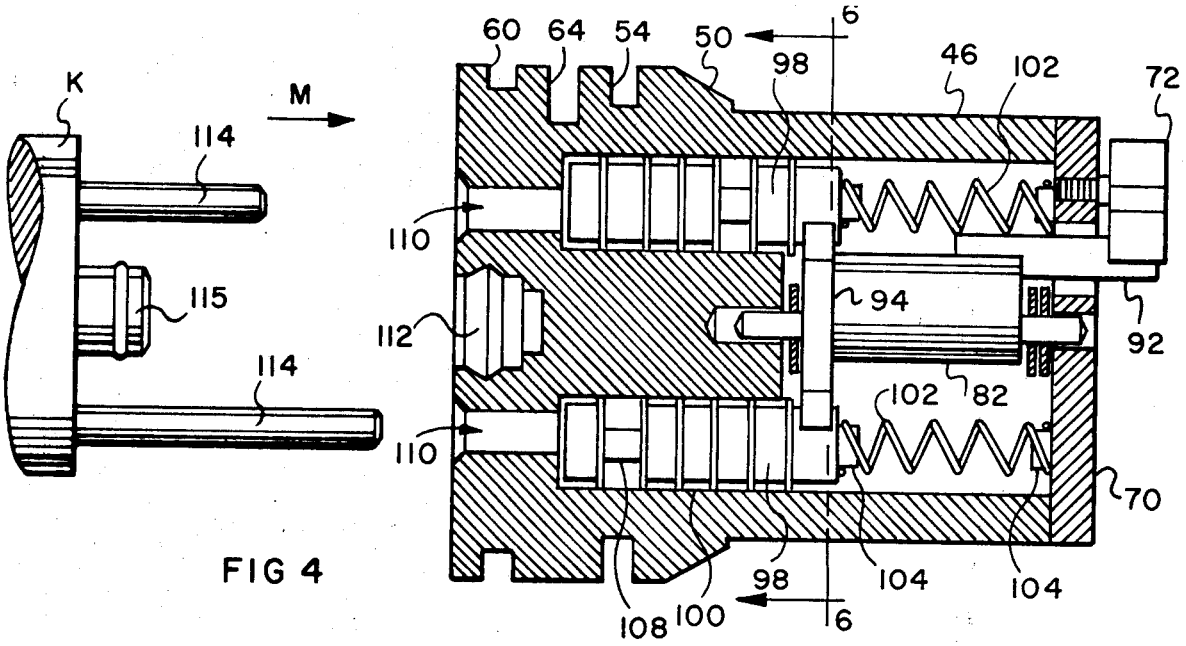
FIGS. 4 and 5 are sectional side elevations corresponding to FIG. 2, showing the barrel only of the lock, before insertion and after insertion of the key respectively.

Referring now to FIGS. 2 and 3, the lock 10 will be further seen to comprise a generally cylindrical hub 20 rotatably carried in the counter-bore 22 at the rear end of the body portion 12. The hasp 18 is fastened to the threaded stub member 24 extending from the hub 20 by means of a nut 26. In accordance with well known practice, the stub member 24 is provided with flats on one or both sides, and the arm 18 is provided with an opening having a corresponding shape (not shown) whereby to ensure that the arm 18 cannot rotate relative to the stub 24.

The hub 20 is fastened within the body 12 by means of the spring circlip 28, fitting within registering grooves 30 and 32 in the hub and main body respectively.

A sealing washer 34 is located in a further groove 36 formed in the hub 20 and seals the rear end of the body 12 against the entry of dirt or any foreign matter. It also provides for a certain frictional grip between the hub 20 and the body 12 to restrain inadvertent rotational movement of the hub 20 relative to the body 12.

The hub 20 is further provided with a pair of abutments or clutch dogs 38 separated approximately 180° from one another around the central axis of the hub 20.

The body 12 is provided with an inner bore 40 of reduced diameter in relation to the counter-bore 22, and at the front end of the body 12 a further enlarged counter-bore 42 is formed, with an angled shoulder 44.

Within the bore 40 and counter-bore 42 there is located the generally cylindrical barrel portion 46, having an enlarged head portion 48 and an angled shoulder 50 corresponding to the angling of the shoulder 44, thereby fitting within the bore 40 and counter-bore 42 and being rotatable relative thereto.

The barrel 46 is retained in position by means of the spring circlip 52 riding in registering grooves 54 and 56 formed in the barrel and body 12 respectively.

A sealing washer 58 is located in a groove 60 formed in the head 48 of the barrel 46 for preventing entry of foreign matter.

An indexing ball 62 is located in a radial bore 64, which also contains a spring 66. A recess 68 is provided in the inner surface of the bore 42 to receive the ball 62 and provide an indexing point.

Attached to the rearward or inner end of the barrel 46 is a back plate or disc 70, being attached thereto by any suitable screw fastening means or the like (not shown).

On the exterior or rearward side of the plate 70 the clutch member 72 is swingably mounted by means of the pivot pin 74. The clutch 72 has two teeth 76 on either side thereof, and it also has a central notch 78. Registering with the notch 78 is a slotted opening 80 formed in the plate 70, giving access from the interior of the barrel 46, to the area behind the plate 70. Stop pins 81 extend from the plate 70 to restrict swinging movement of the clutch 72 to a predetermined arc.

The clutch operating member 82 is located within the hollow interior 84 of the barrel 46 and will be seen to be of a generally cylindrical shape, mounted on a pivot pin 86 which is offset relative to the central axis and centre of gravity of the cylindrical member 82. The member 82 could obviously be made in a different shape so long as the pivot pin 82 is offset from its centre of gravity. The pivot pin is located along the central axis of the barrel 46, and is supported at one end in the central pivot opening 88 formed in the plate 70, and at the other end in a central bore 90 formed in the barrel 46. In this way, by offsetting the mass of the cylindrical operating member 82 relative to the pivot pin 86, the operating member 82 will respond to the influence of gravity, when it is free to rotate within the barrel 46.

Extending rearwardly from the operating member 82 is a clutch engaging blade 92 which is located on the perimeter of the operating member 82 as far as possible from the axis of pivot pin 86 thereby still further adding to the inherent out of balance characteristic of the operating member 82. The blade 92 extends through the opening 80 in the plate 70, and is received within the notch 78 in the clutch 72. The dimensions of the notch 78 are such as to provide a certain degree of clearance on either side of the blade 92 to allow for a limited amount of free movement of the clutch 72 relative to the blade 92 the amount of such tolerance or free play being insufficient to permit inadvertent engagement of the clutch 72 with either of the dogs 38, for reasons to be described below.

In order to control free rotation of the clutch operating member 82, a clutch control plate 94 is provided, attached to the clutch control member 82, or alternatively formed integrally therewith, so as to rotate together with the clutch operating member 82 in unison. The plate 94 is provided with a plurality of, in this case four, semicircular notches 96, formed around the periphery of the plate 94 at equally spaced intervals, thereby giving the plate 94 the appearance of a cross.

A plurality of, in this case four, pin or plunger members 98 fit slidably within respective bores 100 formed in the barrel 46. The bores 100 are formed parallel with the central axis of rotation of the barrel 46, equally spaced around such central axis, and opening rearwardly into the hollow interior 84 of the barrel 46. Each of the plungers 94 is provided with a spring 102, fastened in position on suitable bosses 104. Each of the plungers 98 has an outside diameter adapting it to make a good sliding fit in one of the notches 96 so that the plungers 98 may fit within the notches 96, and yet slide to and fro relative thereto.

Each of the plungers 98 is formed with an annular groove or waist 106, having a predetermined width somewhat greater than the thickness of the clutch control plate 94. The annular grooves or waists 106 are located at different positions on different ones of the plungers 98, along their length. For example, in the particular embodiment of the invention as illustrated, it will be noted that the waist 106 has a width corresponding to about one-seventh of the length of a plunger 98. The annular grooves or waists 106 do not of course completely sever the plunger into two portions, but leave a reduced neck portion 108 joining the two cylindrical portions of the plunger, thus enabling the plungers 98 to function essentially as tumblers for securing or releasing the clutch control plate 94.

The plungers 98 are also preferably provided with a plurality of annular ribs 107 at spaced intervals to provide false grooves or waists rendering picking of the lock more difficult.

In order to move the plungers 98 axially, and thus bring the waists 106 into alignment with the clutch control plate 94, bores or keyways 110 are formed in the front portion of the barrel 96 there being one such bore 110 for each plunger 98. The bores 110 are eccentric with respect to the plungers 98 to make it more difficult to drill them out and remove the plungers. In addition, in order to assist in location of the key K a further central recess 112 is provided.

The key K is provided with a plurality of, in this case four, rod members 114, one for each of the bores 110 of a diameter suitable to make an easy sliding fit within the bores 110. The rods 114 are of the appropriate length necessary to displace the plungers 98 axially and compress the springs 102, and bring the waists 106 of the plungers 98 into registration with the clutch control plate 94.

An indexing mark may be scribed on the key K to indicate the twelve o'clock position of the key so that it may be inserted in the correct manner. Alternatively, the handle H of the key K may perform the same function.

The key K is also provided with a suitable central boss 115 fitting within the recess 112, and preferably having some form of spring circlip or rubber O ring or the like making a good snap fit within the recess 112, thereby providing a positive indication of the correct position for insertion of the key.

In order to provide for a greater variety of lock combinations, a plurality of, in this case three, spacer washers 116 are provided on the pivot pin 86 carrying the clutch operating member 82.

During manufacture of the lock, the spacer washers 116 may be placed at various different positions, thereby locating the entire clutch operating member 82 and clutch control plate 94 at a different axial position relative to the plungers 98.

It will of course be noted that the bore 90 is of sufficient length to receive the pivot pin 86 if all three washers 116 should be placed at the rearward end of the pivot pin 86, and that likewise there is sufficient space behind the plate 70 if all three washers should be placed at the forward end of the clutch operating member 82.

STATEMENT OF OPERATION

1. LOCKED POSITION

The locked position is shown in FIGS. 2, 4, 6, 8 and 9.

When locked, the plungers 98 are shown fully seated in their bores 100 and the springs 102 are fully extended. In this position, the plungers 98 are received within respective semicircular notches 96 in the clutch control plate 94. The clutch control plate 94 cannot therefore rotate relative to the plungers 98. This therefore makes it impossible for the clutch control member 94 or the clutch operating member 82 to rotate relative to the entire barrel 46. For all intents and purposes therefore the clutch control member 82 is locked relative to the barrel 46.

The barrel 46 however is free to rotate within the body 12, the only resistance to rotation being that of the indexing ball 62, which will clearly be able to click readily in and out of its recess 68, and the slight frictional resistance of the sealing washer 58.

If therefore anyone should attempt to tamper with the lock, all that will happen is that the barrel 46 will rotate round and round.

Figure 8:
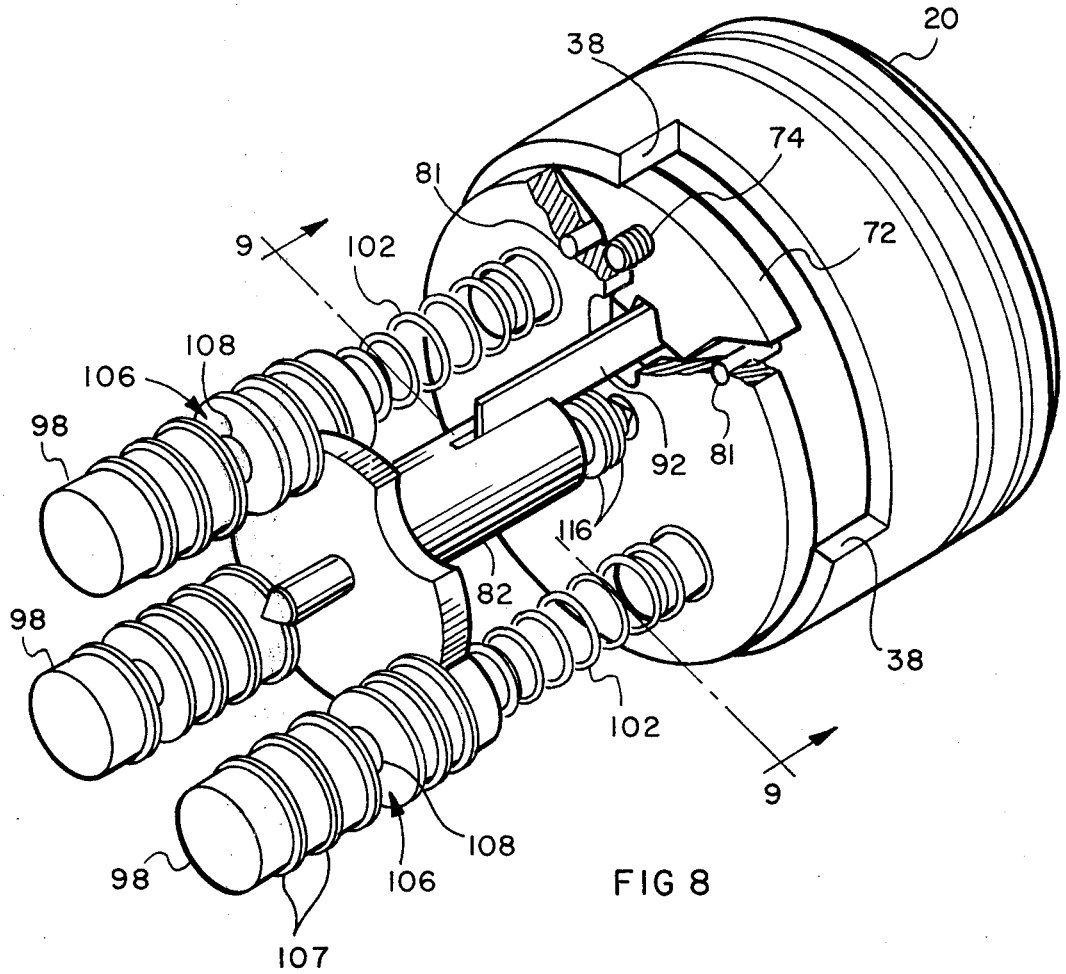
FIG. 8 is an enlarged perspective illustration showing the plungers and clutch locking member in isolation, with the barrel omitted for the sake of clarity, and, FIGS. 9 and 10 are sectional end views along the line 9—9 of FIG. 8, showing the relative movement of the clutch and clutch locking member during movement of the clutch from its disengaged to its engaged position.
Figure 9:
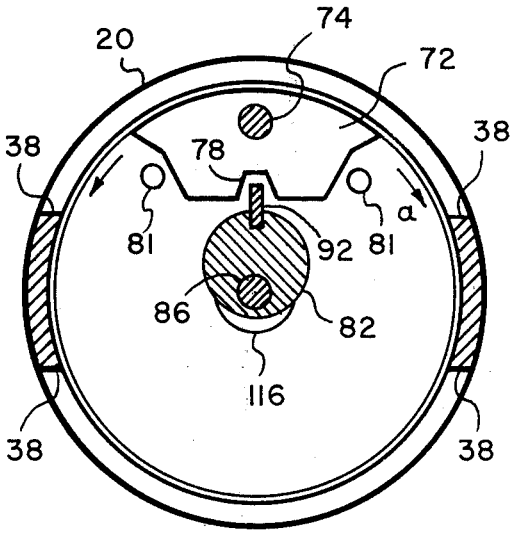

During this condition, the clutch 72 will remain in the position shown in FIGS. 8 and 9. In this position, the clutch 72 is held against tilting motion by the blade 92 engaging in the notch 78. The blade 92 is held by the clutch operating member 82 which is in turn incapable of rotating within the barrel 46 as described above.

Thus even though the barrel 46 is rotated within the body 12 the clutch 72 will rotate together with the back plate 70, but cannot tilt or swing on its pivot pin 74 to any appreciable extent dur to the engagement of the blade 92.

During this time the hub 20, in the rear of the body 12 will remain stationary with the locking arm 18 engaged with any suitable locking plate, locking bar or any other locking means (not shown) either incorporated in a doorway or cabinet, or in any other locking mechanism, the details of which are irrelevant for the purposes of this explanation. Since there is no connection between the barrel 46 and the hub 20, in the locked condition of the lock, then no matter how much the barrel 46 is rotated, the hub 20 will remain undisturbed and the locking arm 18 will remain locked.

2. UNLOCKED POSITION

Figure 5:
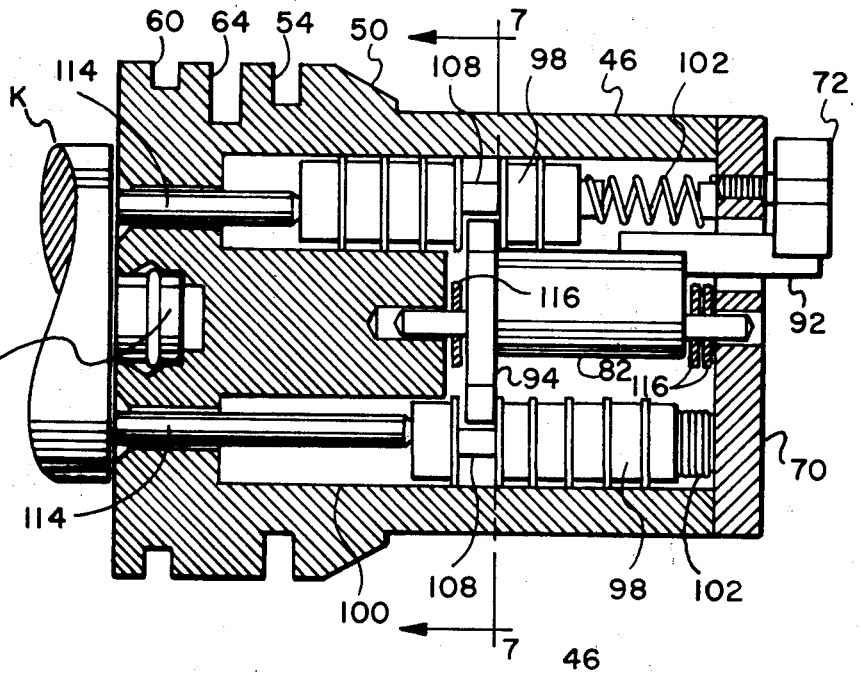
Figure 6:
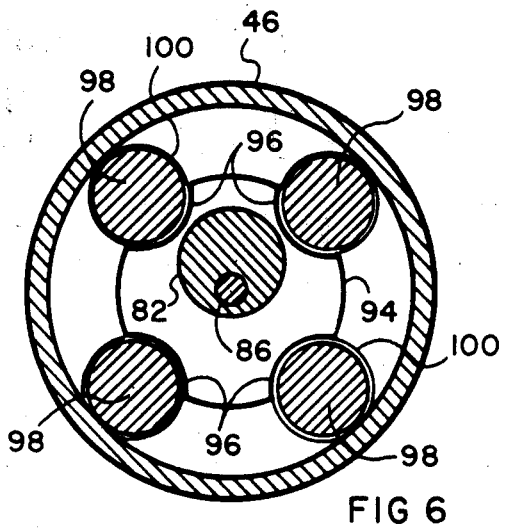
FIGS. 6 and 7 are sectional elevational views along the lines 6—6 and 7—7 of FIGS. 4 and 5 respectively showing the position of the plungers relative to the clutch locking member, before and after insertion of the key respectively.
Figure 7:
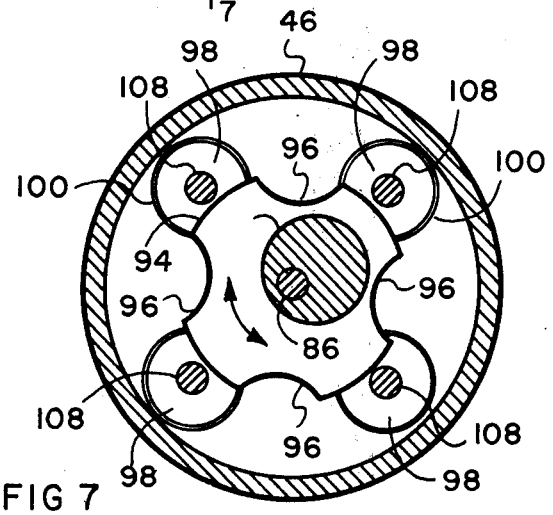
Figure 10:
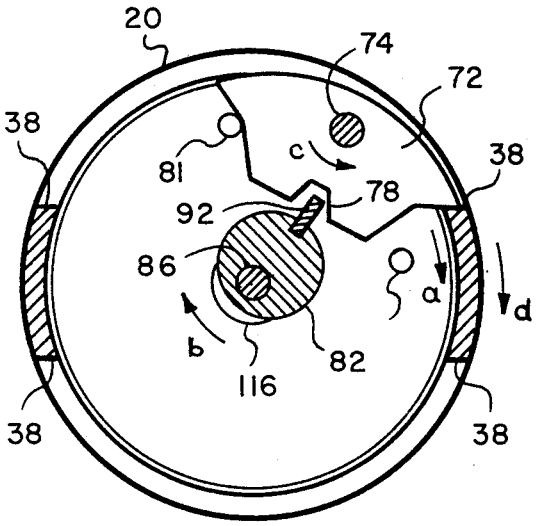

The unlocked position is shown in FIGS. 5, 7 and 10.

When the key K is inserted, the rods 114 will enter the bores 110 and contact the plungers 98. Continued insertion of the key K until the boss 115 seats in the recess 112 will produce displacement of the plungers 98 to the full extent of the length of the rods 114, less the length of the access bores 110.

It is of course assumed that the key K has been inserted with the index mark M or handle H indicating its twelve o'clock position so that the correct rods 114 are inserted in their respective bores 110. If however this has not been carried out correctly, either the key K is rotated into an incorrect orientation, or alternatively the barrel 46 has been rotated so that the indexing ball 62 is not seated in the recess 68, then it will of course be possible for the rods 114 to be inserted in the wrong bores 110. If this should occur then the displacement of the plungers 98 will be ineffective, and it will be necessary to remove the key K and either realign it with the barrel 46 or alternatively rotate the barrel 46, by means of the key, until the indexing ball 62 clicks into its recess 68 at which time the key K can then be withdrawn and reinserted in the correct orientation.

Assuming however that the key K is inserted correctly as described above, then the displacement of the plungers 98 will be such that each of the plungers 98 is displaced by a predetermined distance such that its respective waist 106 will register with the clutch control plate 94. When this occurs, the clutch control plate 94 is then free of any engagement with the plungers 98, and may freely rotate. This of course will release the clutch operating member 82 and blade 92 which are all free to move together with the clutch plate 94 as a single integral unit.

As the key is then rotated, in either direction i.e. clock-wise or anticlock-wise, the clutch operating member 82 will then respond to the influence of gravitational forces, and will rock, or rotate relative to the barrel 46. Such rocking movement will then be communicated by the blade 92 to the clutch 72. The clutch 72 will then forced to rock in the opposite rotational direction to the rocking movement of the clutch operating member 82. This will displace one of the clutch teeth 76 slightly inwardly against its associated stop pin 81, and will rock the other clutch tooth 76 outwardly. This will bring the tooth 76 into engagement with one of the dogs 38 on the hub 20.

Continued rotation of the key K will thus be transmitted through the clutch 72 to the hub 20 thereby rotating the locking arm 18 and moving it from its locked to its unlocked position.

In order to lock the lock once more, the key will be operated to rotate the barrel back into its indexed position which may be indicated in a variety of ways as described above. In this position, the barrel will then be located in such a position that the operating member 82 is more or less balanced with respect to gravitational forces. As the key is withdrawn, the pin or plunger members 98 will be driven forwardly by their springs 102. As the plunger members 98 move forwardly, they will engage the plate 94, and enter the recesses 96. The rearward edges of plate 94 may be chamfered, or rounded so as to facilitate such movement, and the lock will then once more be in its locked position.

The foregoing is a description of a preferred embodiment of the invention which is given here by way of example only. The invention is not to be taken as limited to any of the specific features as described, but comprehends all such variations as come within the scope of the appended claims.

What is claimed is:

1. A barrel type lock adapted to be operated by a key and comprising;

housing means having front and rear ends and a hollow interior;

barrel means rotatably mounted for rotation about a predetermined axis within said housing means and adapted to receive said key for rotation thereof;

hub means rotatably mounted at the rear of said housing and being rotatable independantly of said barrel means about the same said axis and adapted for interconnection with any suitable locking means;

abuttment means on said hub means by means of which said hub means may be rotated;

a movable clutch member on said barrel means, movably mounted thereon for movement between abuttment engaging and disengaging positions, said barrel means being rotatable independantly of said hub means when said clutch member is in its disengaging position;

a clutch operating member swingably mounted in said barrel means for swinging between clutch operating and clutch non-operating positions, and interconnecting with said clutch member whereby to hold same in its abuttment disengaging positions, when it is in its clutch non-operating position, and releasing same for movement into its abuttment engaging position when it is in its clutch operating position, and, a plurality of securing pins slidably mounted in said barrel means interengaging with said clutch operating member and normally securing the same against swinging relative to said barrel means, and being slidably movable along axes parallel to the axis of said barrel means into predetermined positions in response to insertion of said key to thereby free said clutch operating member and permit the same to swing relative to said barrel means aforesaid into its clutch operating position.

2. A barrel type lock as claimed in claim 1 including sealing means arranged between the barrel means and said housing means to prevent entry of foreign matter therebetween, and further sealing means arranged between said hub means and said housing means.

3. A barrel type lock as claimed in claim 1 wherein said clutch member is swingably mounted on one end of said barrel means, and incorporates at least one tooth member, and wherein said abuttment means on said hub means is engagable by said tooth when said clutch member is swung relative to said barrel means, and said barrel means is rotated.

4. A barrel type lock as claimed in claim 1 wherein said clutch member is swingably mounted on said barrel means, and defines two ends comprising tooth members, and being swingable in response to the influence of gravity;

and wherein said clutch operating member comprises a body swingably mounted within said barrel means for swinging about said predetermined axis thereof, said swinging axis being offset with respect to the center of gravity of said body whereby to render the same swingable in response to the influence of gravity, connecting means connecting between said body and said clutch member, swinging of said body in one direction, procuring, through said connecting means, tilting of said clutch member in the opposite direction, and said connecting means being operative to restrict swinging of said clutch member independantly of said body, whereby, when said clutch operating member is secured by said securing means against swinging relative to said barrel means, said clutch member is also secured against swinging relative to the barrel means.

5. A barrel type lock as claimed in claim 1 wherein said clutch operating member comprises a body rotatably mounted in said barrel means about an axis which is offset with respect to its center of gravity, whereby to render said body swingable about said axis in response to the influence of gravity, and including connection means extending between said body and said clutch member for procuring movement thereof in response to swinging movement of said body.

6. A barrel type lock as claimed in claim 5 including a plurality of spacer washers located at least one end of said body, and positionable at either end of said body whereby varying of said washers may vary the axial position of said body with respect to said barrel.

7. A barrel type lock as claimed in claim 1 wherein said securing pins comprise a plurality of pin members each said pin member being received within a socket formed in said barrel means parallel to its said predetermined axis, and being slidable within said sockets to and fro relative to said clutch operating member, and including spring means normally urging said pin members toward the front end of said barrel means, said pin members being displaceable toward the rear end of said barrel means upon insertion of said key into said barrel means.

8. A barrel type lock as claimed in claim 7 including key means for said lock, said key means including a plurality of key rod members, there being one said rod member for each of said pin members, said rod members being engagable with said pin members to displace the same within their said sockets as aforesaid.

9. A barrel type lock as claimed in claim 7 including plate means on said clutch operating member, recesses formed in said plate means, for reception of respective said pin members, and said pin members being normally received in said recesses and engaging said plate whereby to prevent rotation of said clutch operating member, and including grooves formed in respective said pin members at predetermined locations therealong, whereby, registration of said grooves with said plate means releases said plate means from engagement by said pins and permits rotation of said clutch operating member.

10. A barrel type lock as claimed in claim 9 including a plurality of key ways formed in said barrel in registration with said recesses for said pin members, said key ways being offset slightly with respect to the central axis of said recesses.

11. A clutch assembly for use in association with a barrel type lock having a rotatable barrel, rotation of which is procured and controlled by means of a key insertable therein, and further having a lock operating hub member adapted for connection with a locking member, for moving said locking member into and out of locking position, said barrel member and said hub member being rotatable independently of one another, and said clutch assembly drivably interconnecting said barrel member with said hub member for rotation of said hub member in response to rotation of said barrel member, when said key is inserted into said barrel member, said clutch assembly comprising;

abutment means on said hub member;

a movable clutch member, movably mounted on said barrel member, and swingably thereon between abutment engaging and abutment disengaging positions;

a clutch operating member movably mounted in said barrel means, and engaging said clutch member, said clutch operating member being movable between clutch operating and clutch non-operating positions, said clutch operating member being movable with respect to said barrel member by swinging about a predetermined axis, and said clutch operating member having a centre of gravity which is offset with respect to said centre axis of rotation, and said clutch operating member, and said clutch member being swingable relative to one another, and, linkage means interconnecting said clutch operating member and said clutch member whereby to restrict the freedom of said independent movement therebetween and transferring movement of said clutch operating member to said clutch member.

12. A clutch assembly as claimed in claim 11 wherein said clutch member comprises a generally arcuately shaped segment portion swingably mounted on said barrel member, and having a plurality of dog means thereon, one of said dog means being engagable with said abutment member on said hub.

13. A clutch assembly as claimed in claim 12 wherein said clutch operating member comprises a body portion rotatably mounted in said barrel means for rotation about the same axis as the axis about which said barrel means is rotatable the centre of gravity of said body being offset with respect to its said axis of rotation whereby said body is swingable about its said axis in response to the influence of gravity independently of the rotation of said barrel means, and including securing means on said body member, whereby the same may be locked against rotation independently of said barrel means.

14. A clutch assembly as claimed in claim 12 wherein said securing means comprises a plate portion extending outwardly from said body, and a plurality of notches formed in said plate portion at spaced intervals therearound.

15. A clutch assembly as claimed in claim 14 including a back wall portion on said barrel means, said clutch member being mounted on the exterior of said back wall portion, in said clutch operating member being mounted within said barrel means, and separated from said clutch member by said wall portion, and wherein said linkage means extends through an opening formed in said wall portion from said clutch operating member into engagement with said clutch member.

* * * * *